United States Patent [19]

Hofmann et al.

[11] Patent Number: 4,563,138

[45] Date of Patent: Jan. 7, 1986

[54] COMPRESSOR SYSTEM WITH OIL SEPARATION

[75] Inventors: Rudolf Hofmann, Hofheim; Kurt Magdhuber, Geretsried, both of Fed. Rep. of Germany

[73] Assignee: Isartaler Schraubenkompressoren GmbH, Geretsried, Fed. Rep. of Germany

[21] Appl. No.: 664,081

[22] Filed: Oct. 23, 1984

Related U.S. Application Data

[63] Continuation of Ser. No. 448,400, Dec. 9, 1982, abandoned.

[30] Foreign Application Priority Data

Dec. 11, 1981 [DE] Fed. Rep. of Germany ..... 3149245

[51] Int. Cl.[4] ..... F04C 29/02; F04C 29/04

[52] U.S. Cl. ..... 418/97; 55/159; 55/462; 418/DIG. 1

[58] Field of Search ..... 418/DIG. 1, 97, 201; 55/462, 463, 464, 438, 159, 192

[56] References Cited

U.S. PATENT DOCUMENTS

| | | | |
|---|---|---|---|
| Re. 30,994 | 7/1982 | Shaw | 418/97 |
| 1,409,868 | 3/1922 | Kien | 418/DIG. 1 |
| 1,443,764 | 1/1923 | Smith | 418/DIG. 1 |
| 1,604,418 | 10/1926 | Oliphant | 55/463 |
| 1,626,768 | 6/1927 | Vollmann | 418/DIG. 1 |
| 3,820,923 | 6/1974 | Zweifel | 418/DIG. 1 |
| 3,976,452 | 8/1976 | Meier et al. | 55/192 |
| 4,174,196 | 11/1979 | Mori et al. | 418/DIG. 1 |
| 4,278,053 | 7/1981 | Bessouat et al. | 55/463 |

FOREIGN PATENT DOCUMENTS

| | | | |
|---|---|---|---|
| 2822780 | 5/1978 | Fed. Rep. of Germany | 418/DIG. 1 |
| 2940211 | 4/1981 | Fed. Rep. of Germany | 418/DIG. 1 |
| 8103207 | 11/1981 | World Intl. Prop. Org. | 418/DIG. 1 |
| 1318884 | 5/1973 | United Kingdom | 418/97 |
| 2020750 | 11/1979 | United Kingdom | 418/97 |

*Primary Examiner*—Michael Koczo
*Assistant Examiner*—Randolph A. Smith
*Attorney, Agent, or Firm*—Wood, Dalton, Phillips, Mason & Rowe

[57] ABSTRACT

To design a compressor system with a screw-type compressor, the housing of which has cavities for air guidance and oil separation, in an economical way for small delivery quantities, there is a disc-shaped housing with a longitudinal dimension corresponding essentially to the rotor length, and in this housing the compressed air flowing out of the compressor and mixed with oil is deflected in a radial and a peripheral direction for oil separation. The oil separator, the oil filter and the air filter are attached as separate units to the end face of this housing. The bearing plate of the drive motor is designed as a mechanical transmission space.

15 Claims, 6 Drawing Figures

COMPRESSOR SYSTEM WITH OIL SEPARATION

This application is a continuation of application Ser. No. 448,400, filed Dec. 9, 1982 which is now abandoned.

The invention relates to a compressor system with an oil injection screw-type compressor with improved means for separating the oil from the compressed air.

German Offenlegungsschrift No. 2,938,557 makes known a compressor system in which there are formed in a compact housing, in addition to the rotors of the screw-type compressor, also cavities for air guidance and oil separation and for receiving the oil which is injected into the compression space of the screw-type compressor for cooling purposes. This known compressor system is designed for relatively large delivery quantities.

The object on which the invention is based is to design a compressor system of the type mentioned in the introduction, so that it can be used economically for delivering smaller quantities of compressed air and for this purpose also has an even more compact construction.

This object is achieved essentially by means of structure in the housing which directs the air around the walls of the rotor bores and against a deflecting wall. The outlet orifice for the air is above the deflecting wall. Because the compressed air flowing out of the compression space is conveyed through the housing in a peripheral direction essentially radially and approximately in the plane of the rotors, maximum utilization of the flow path for oil separation is obtained, with at the same time a very short overall length of the housing. By means of the deflecting surface above the channel leading upwards from the outflow orifice of the compression space, the air stream is divided up, with the result that its velocity is limited, oil separation being assisted by a rebound effect, so that good oil separation is achieved despite the short overall length.

Advantageous embodiments of the design according to the invention are indicated in the sub-claims.

An exemplary embodiment of the invention is explained in more detail below with reference to the drawings, in which:

FIG. 5 shows a section along the line C-D of FIG. 3; and

FIG. 6 shows a partial section along the line E-F of FIG. 3.

Figure 1:
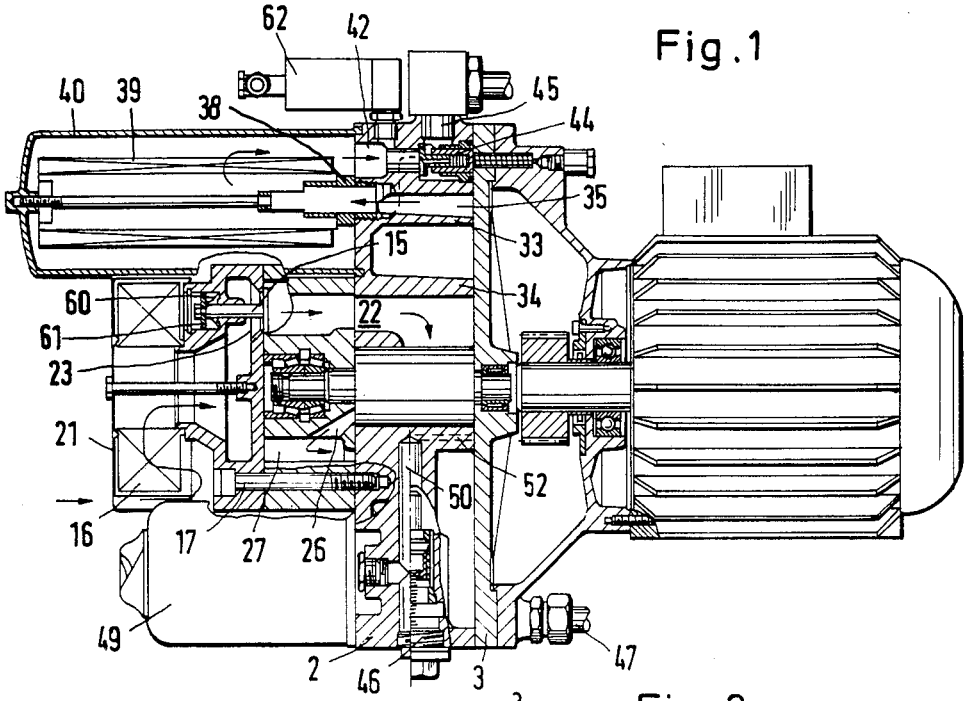
FIG. 1 shows a side view of the entire compressor system in a partial vertical section along the center axis of the compressor system.
Figure 2:
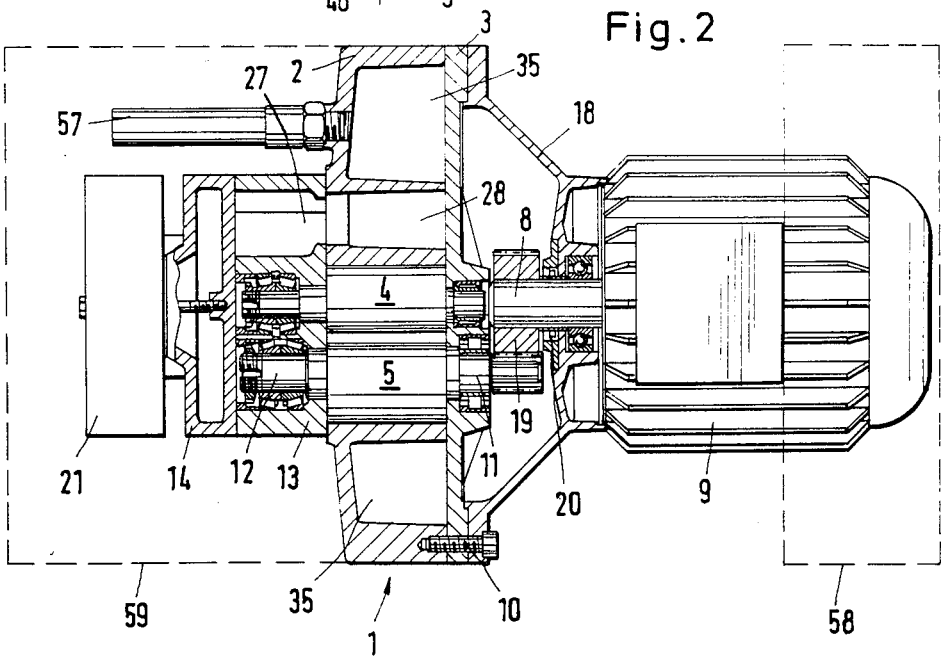
FIG. 2 shows a plan view of the compressor system according to FIG. 1, in a partially horizontal section along the center axis.

In the Figures, 1 denotes a disc-shaped housing which consists of an approximately pot-shaped part 2 and a flat lid-shaped part 3 (FIGS. 1 and 2). The pot-shaped part 2 has a longitudinal dimension corresponding to the length of the rotors 4, 5 which are introduced into intersecting bores 6, 7 (FIGS. 3 and 4) in the housing. These bores 6, 7 are located approximately in the center of the housing 1 which is approximately circular on the outer periphery. In the exemplary embodiment illustrated, the axis of the bore 6 lies on the center axis of the housing 1 which coincides with the axis of the drive shaft 8 of an electric motor 9. The lid-shaped part 3 of the housing is fastened by means of screws 10 to the open side of the pot-shaped part 2, these screws 10 being arranged along the periphery of the housing (FIG. 4).

On the suction side of the rotors 4, 5 their bearings 11 are located in bores in the lid-shaped part 3. On the pressure side, the rotor bearings 12 rest in a disc-shaped housing part 13 which is likewise made approximately circular on the outer periphery, but has a substantially smaller diameter and corresponds approximately to the circular line 13' located in the center in FIG. 3. Attached to the end face, on the left in FIGS. 1 and 2, of this housing part 13 is a disc-shaped hollow suction piece 14 in which a suction controller 15 (FIG. 1) is located and which carries an air filter 16. The suction piece 14 is fastened to the housing 1, together with the housing part 13, by means of screws 17.

A bearing plate 18 of the electric motor 9 is fastened to the lid-shaped housing part 3 by means of the screws 10, and the mechanical transmission 19 for driving the rotors is located in a funnel-shaped projection of the bearing plate 18. This mechanical transmission space is sealed off from the electric motor 9 by a gasket 20. A bore (not shown) leads from the oil sump of this mechanical transmission space into the suction region of the screw-type compressor, so that the oil penetrating into the mechanical transmission space is drawn off continuously.

In the exemplary embodiment illustrated, the annular air filter 16 is provided with a cover hood 21, the outside diameter of which corresponds to that of the housing part 13 and of the suction piece 14, there being between the latter and the hood edge an annular gap for the inflow of the air sucked in. As indicated by an arrow in FIG. 1, the air sucked in is deflected 180° twice before it enters the central orifice in the suction piece 14.

Figure 3:
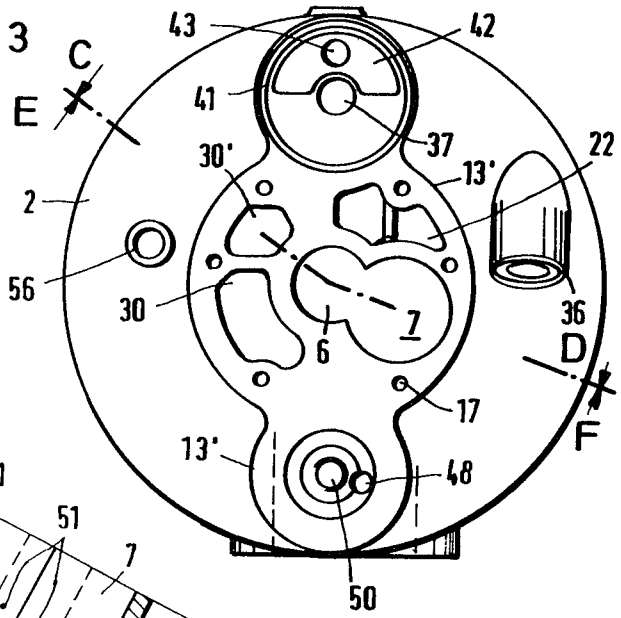
FIG. 3 shows a view of the disc-shaped housing from the left in FIGS. 1 and 2.
Figure 4:
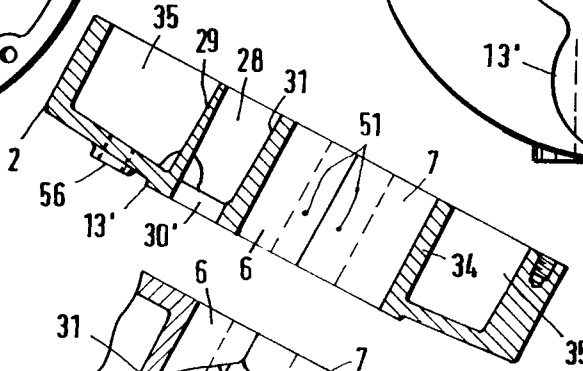
FIG. 4 shows a view of the disc-shaped housing from the right in FIGS. 1 and 2.
Figure 4:
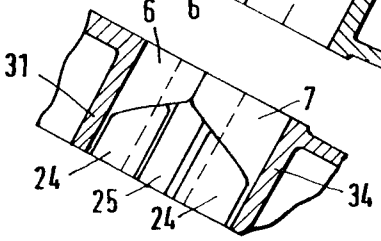
Figure 4:
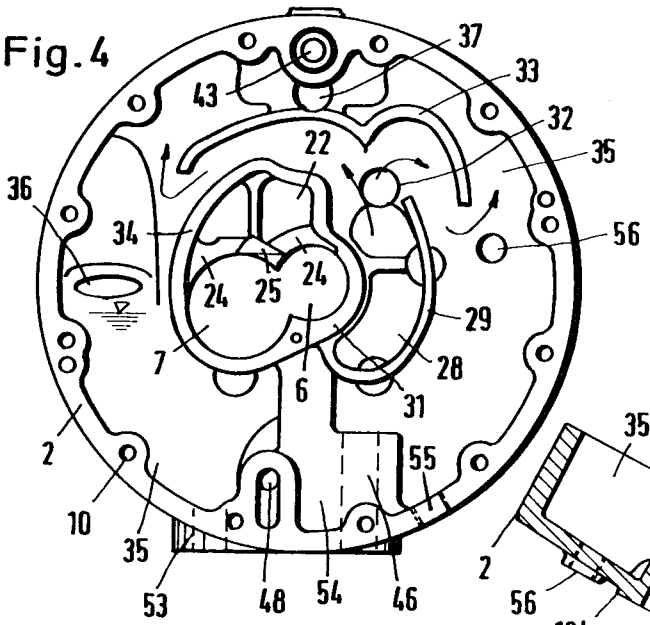

A portion of a suction channel 22, which can have the cross-sectional shape illustrated in FIGS. 3 and 4, is formed in the housing part 13 by means of a recess extending approximately parallel to the center axis. An orifice 23 opens into this suction channel on the right-hand end face of the suction piece 14. The suction channel 22 is continued in the housing part 2 by means of a recess extending axially. The air sucked in passes through a radial suction orifice 24 into the compression space between the rotors 4 and 5. The shape of this radial suction orifice 24 is evident from FIGS. 4 and 6. It extends over some of the periphery of the two rotors, a web 25 being located approximately in the center of the suction orifice.

As shown in FIG. 1, the length of the rotors is made very short because of the small delivery quantity. The outflow orifice from the compression space is formed by an oblique channel 26 in the housing part 13 which leads downwards and starts from the bores 6, 7 for the rotors in the housing part 2 and which opens into a cavity 27 in the housing part 13, which is covered on the left-hand side by the suction piece 14 and opens on the right-hand side into a channel 28 formed by a wall portion 29 in the housing part 2 (FIG. 4).

The mouth orifice, on the right in FIG. 1, of the cavity 27 merges into the lower part of the recess 30 (FIG. 3) on the end face, on the left in FIG. 1, of the housing part 2. Like the channel 28, this recess 30 extends upwards in a curved form along the wall 31 of the rotor bore 6. It is interrupted by a web merely for reasons of strength. The channel 28 closed at the bottom by the wall 29 and open at the top extends essentially over the longitudinal dimension of the housing part 2 (FIG. 2), this channel 28 being connected in an axial direction via the recesses 30, 30' to the cavity 27 in the housing part 13 which extends upwards (FIG. 2) from below the rotor bearing 12 (FIG. 1) according to the form of the channel 18. The channel 28 is prolonged by the cavity 27 over the longitudinal dimension of the housing part 13. As is seen in FIG. 3, the cavity 27 extends approximately up to the top edge of the recess 30', followed in a peripheral direction by the suction channel 22 which is located above the bores 6, 7 for the rotors. The channel 28 continues upwards in the housing part 2 (FIG. 4) and located above the mouth orifice 32 of this channel, at a distance from the latter, is a deflecting wall 33 which extends over the longitudinal dimension of the housing part 2 (FIG. 1). This deflecting wall 33 takes the form, shown in FIG. 4, of, for example, two arcs adjoining one another, with the result that the air stream rising through the channel 28 is divided up and guided downwards to the right and left, as shown by the arrows in FIG. 4. As a result of the impact of the stream of compressed air against the deflecting wall 33 and as a result of deflection, oil is separated, and this oil flows down, above all, on the outer side of the wall 29 and the wall 34 which surrounds the housing bore 7 and the suction channel 22.

The inner part, formed by the wall portions 29, 31, 33 and 34, of the pot-shaped housing part 2 is surrounded by an approximately annular cavity 35 in this housing part 2. This annular cavity 35 serves, in the lower portion, as an oil vessel. The oil level is indicated in FIG. 4 and lies somewhat below a filling orifice 36 which is arranged countersunk in the housing part 2 and is directed downwards in FIG. 3. Approximately the top half of the annular space 35 serves for conveying compressed air, there being formed above the deflecting wall 33, on the end face, on the left in FIG. 1, of the housing part 2, a bore 37 into which is screwed a pipe connection 38 of an oil separation cartridge 39. The compressed air flows from the inside outwards through the oil separation cartridge 39 which is covered on the end faces and which is surrounded by a tubular housing 40 engaging sealingly into an annular groove 41 (FIG. 3). Formed above the bore 37 in the end face of the housing part 2 is a semicircular recess 42 from which a bore 43 leads to the minimum-pressure valve 44 (FIG. 1). Screwed into a radial bore 45 at the topmost point of the housing part 2 is the pressure line which, if appropriate, leads to the consumer via an aftercooler (not shown).

At the point located diametrically opposite the bore 45, a thermostat valve 46 is inserted into the housing part 2 likewise in a radial direction. From the lower part of the annular space 35, a line 47 leads to an oil cooler (not shown), from which a line (not shown) leads via a bore 48 opening into an annular groove into an oil filter 49, from which the cooled and purified oil is injected through a bore 50 via injection orifices 51 (FIG. 5) into the compression space and passes via a line 52 (FIG. 1) into the mechanical transmission space. The thermostat valve 46 is closed in the higher temperature range. When the thermostat valve 46 is fully opened, the oil cooler (not shown) is short-circuited, and the oil under the delivery pressure in the annular space 35 is pressed through the thermostat valve 46 to the injection orifices 51.

The thermostat valve 46 is located, together with an oil flow-off 53 and the line 50 leading from the oil filter 49 to the injection orifices, in a pedestal-shaped part 54 of the housing which is provided with a plane surface on the underside, as emerges from FIGS. 3 and 4. In FIG. 4, a radial threaded bore is provided at 55 for connecting the line leading to the oil cooler.

An offset plane end face with the limiting line 13' in FIG. 3 is formed on the predominantly closed end face of the housing part 2, and the housing part 13, the oil filter 49 and the tubular housing 40 of the oil separator are attached to this plane surface. The oil filling orifice 36 is provided on one side of the surface extending approximately from the top downwards diametrically over the housing part 2 and an axial bore 56 is provided on the other side (FIG. 3), a safety valve 57 being screwed into this axial bore (FIG. 2). Because of the pot-shaped design of the housing part 2, the latter can be made without undercuts, apart from the radial bores, so that it can be produced by die-casting. The housing preferably consists of aluminum.

The oil collecting in the housing 40 of the oil separator is drawn off through a channel (not shown) which leads into a region of lower pressure in the screw-type compressor.

FIG. 2 indicates diagrammatically, at the exposed end of the electric motor 9, an annular cooler 58 which preferably has the design described in German Utility Model No. 8,127,075. In addition to this oil cooler, an annular aftercooler for the compressed air can also be arranged round the electric motor. The fan wheel of the electric motor 9 is located within the hood 58 of the annular cooler. As a result of intensive cooling of the electric motor 9, it is possible to provide a small electric motor for the drive, with the result that the compressor system becomes lighter and more compact. Preferably located on the left-hand end face of the housing 1 is a cover hood, indicated at 59 in FIG. 2, which screens the oil separator, the air suction region with the air filter 16, and the oil filter 49 off from the heated cooling air which is blown via the electric motor 9 and the housing 1 by the fan wheel (not shown) located at the right-hand end of the electric motor 9. This cover hood 59 can be open completely or partially on the left-hand end face for the inflow of air to the compressor. If this cover hood 59 is designed appropriately, there is no need for the cover 21 of the air filter 16.

The rotor bearings 11 are open opposite the mechanical transmission space, whilst the bores into which the rotor bearings 12 are inserted are covered by the suction piece 14. The rotor bearings 12 are lubricated through an oil bore (not shown) as described in German Utility Model No. 8,016,349.

Because of its small volume, the compressor builds up pressure very quickly, the minimum-pressure valve 44 first being closed. By means of the air sucked in, the valve body of the suction controller 15 is lifted off from its valve seat at the orifice 23 counter to the force of the spring 60, and it is provided with a piston-shaped disc 61 which is displaceable in an appropriate cylindrical bore in the suction piece 14.

When the compressor is switched off, the piston 61 of the suction controller is subjected to the final pressure via a solenoid valve 62 attached to the top side, so that it closes immediately. However, there is between the periphery of the piston 61 and the cylindrical bore a certain clearance through which air flows out from the interior of the compressor, so that the compressor can be relieved by means of a line which opens into the suction piece 14 outside the piston 61.

When the compressor is switched off, at the same time the piston of the minimum-pressure valve 44 is also subjected to the final pressure by the solenoid valve 62, so that this also closes immediately. The minimum-pressure valve 44 seals off in an essentially leak-proof manner, so that there is no relief on the pressure side, as also described in German Offenlegungsschrift No. 3,146,535.

When the compressor is in operation, the compressed air mixed with oil or another cooling fluid flows out on the end face of the housing part 2 and flows obliquely downwards, whereupon it encounters the limitation of the cavity 27, is deflected upwards and flows back in an axial direction into the channel 28, at the outflow of which the stream of compressed air is divided up, and the two part streams flow down again and round the wall of the rotors practically in a plane of the latter, and finally, after being deflected again flow upwards and out through the outflow orifice 37. Since, when the compressor is started up, a certain supply of oil is present in the bores for the rotors, also during operation the lower part of the cavity 27 is filled with oil until the outflow of the channel 26 and consequently also the outflow orifice of the compressor are practically flooded with oil. A float switch (not shown) monitors the oil level in the annular space 35 and switches the compressor off as soon as the supply of oil drops below a given value. When the compressor is switched off, oil also collects in the cavity 27 and flows back downwards through the channel 28. However, the oil level in the annular space 35 can be higher than that in the cavity 27 when the compressor is stopped.

When it flows out of the compression space, the compressed air first passes into the enlarged cavity 27, 28, thus reducing the velocity. After the stream of compressed air has flowed out of the channel 28, its velocity is kept low because it is divided up. The deflecting wall 33 which divides up the air stream can extend downwards relatively far along the periphery. It can also be made labyrinthine.

Various modifications of the design described are possible. Thus, the housing 1 can also have a different peripheral shape from the circular shape illustrated.

We claim:

1. A compact oil-injected compressor comprising:

a housing (1) with a pair of walls (31,34) defining two bores (6,7) therein;

rotors (4,5) within the bores (6,7), a compression space being defined between the rotors (4,5);

an outlet (26) from the compression space;

a channel (28) connected to said outlet (26) to guide air from said outlet (26) about one of said walls (31,34) in a direction substantially tangential to one of said rotors (4,5), said channel (28) extending generally vertically upward from the bottom outlet (26) around one of the bore walls (31);

a ring-shaped cavity (35) in the housing (1) about the walls (31,34) and channel (28) for air guidance, for pre-separation of oil, and for receiving injected oil;

a mouth orifice (32) opening the channel (28) into the cavity (35);

a deflecting wall (33) opposite the mouth orifice (32), said deflecting wall (33) being adapted to divide the air from the mouth orifice (32) into opposite directions in the cavity (35); and an outflow orifice (37) from said cavity (35), wherein the deflecting wall (33) is disposed between the mouth orifice (32) and the outflow orifice (37).

2. The compressor of claim 1, wherein the deflecting wall (33) is substantially in the form of two arcs adjoining one another.

3. The compressor of claim 1, wherein the housing (1) is disc-shaped and corresponds essentially to the longitudinal dimension of the rotors (4,5) and the channel (28), the deflecting wall (33) and the annular cavity (35) extend essentially over the longitudinal dimension of the housing.

4. The compressor of claim 3, wherein the housing (1) is composed of a pot-shaped housing part (2) and a lid-shaped housing part (3) in which rotor bearings (11) are located.

5. A compact compressor having oil injected therein, a housing (1) including a pair of walls (31,34) defining two generally horizontal bores (6,7) with a bottom outlet (26), rotors (4,5) within the bores (6,7) and having a longitudinal dimension, a compression space between the rotors (4,5) and having an inlet (24), a first end, and a second end on which a rotor drive is mounted, said compressor further including the improvement comprising:

a channel (28) extending generally vertically upward from the bottom outlet (26) around one of the bore walls (31);

a ring-shaped cavity (35) in the housing surrounding the walls (31,34) for air guidance and pre-separation of oil and for receiving the injected oil;

an upwardly open mouth orifice (32) opening the channel (28) into the cavity (35);

an outflow orifice (37) in the cavity (35) above the mouth orifice (32) and at the first end of the compressor;

an oil separator (39) mounted to the housing at the first end of the compressor and communicating with the cavity (35) through the outflow orifice (37);

an air filter (16) mounted to the first end of the compressor and connected with the inlet (24); and a deflecting wall (33) disposed between the mouth orifice (32) and the outflow orifice (37) to divide air from the mouth orifice (32) in opposite directions into the ring-shaped cavity (35);

wherein the housing (1) is disc-shaped and corresponds essentially to the longitudinal dimension of the rotors (4,5) and the channel (28), the deflecting wall (33) and the cavity (35) extend essentially over the longitudinal dimension of the housing.

6. The compressor system according to claim 5, characterized in that the deflecting wall (33) forms an approximately T-shaped branch in conjunction with the mouth orifice (32) of the channel (28), one channel portion being directed downwards along the wall (34) of the rotor bores and the other channel portion being directed downwards on the outside of the wall (29) which limits the channel (28) extending upwards.

7. The compressor system according to claim 5, characterized in that the deflecting wall (33) is designed approximately in the form of two arcs adjoining one another.

8. The compressor system according to claim 5, characterized in that the cavity (35) in the housing (1) surrounding the wall (31, 34) of the rotor bores is made annular, the deflecting wall (33) extending over a large part of the top half of this annular cavity (35).

9. The compressor system according to claim 5, characterized in that the housing (1) is composed of a pot-shaped housing part (2) and a lid-shaped housing part (3) in which the rotor bearings (11) are located.

10. The compressor system according to claim 5, characterized in that there is formed in the housing (1) by means of a cavity (22) extending in an axial direction a suction line (22) which opens via the compression space inlet (24) into the bores (6, 7) for the rotors.

11. The compression system according to claim 10, characterized in that attached to the compressor at the compression space outlet (26) is a disc-shaped housing part (13) which receives the rotor bearings (12) and which is provided with two cavities which are separated from one another and extend in an axial direction and one of which forms a prolongation of the suction line (22) whilst the other cavity (27) extends over some of the periphery of this housing part (13) around the rotor bearings and is connected to the channel (28) on the end face, there opening into the lower part of the cavity (27) a channel (26) which leads obliquely downwards and which is connected to the end of the rotor bores (6,7) on the pressure side.

12. The compressor system according to claim 11, characterized in that located on the housing part (13) is a disc-shaped hollow suction piece (14) which covers the cavity (27) of the housing part (13) and the bearing bores and which is provided with a suction controller (15) at the orifice (23) communicating with the suction line (22).

13. The compressor system according to claim 5, characterized in that fastened sealingly on the end face of the housing (1) is a tubular housing (40), the axis of which is parallel to the longitudinal axis of the rotors and which surrounds an oil separation cartridge (39).

14. The compressor system according to claim 5, characterized in that fastened sealingly on the end face of the housing (1) is an oil filter (49), the axis of which is parallel to the housing axis.

15. The compressor system according to claim 5, characterized in that provided for an electric motor (9) is a funnel-shaped bearing plate (18) which is fastened to the housing (1) and which serves as a mechanical transmission space.

* * * * *